US005471725A

United States Patent [19]

Thrasher

[11] Patent Number: 5,471,725

[45] Date of Patent: Dec. 5, 1995

[54] METHOD FOR MANUFACTURING MATTRESSES OR BOX SPRINGS, INCLUDING IMPROVED SPRING TRANSFER

[75] Inventor: Otis Thrasher, McDonough, Ga.

[73] Assignee: Simmons Company, Atlanta, Ga.

[21] Appl. No.: 238,814

[22] Filed: May 6, 1994

[51] Int. Cl.[6] ..... B68G 7/00

[52] U.S. Cl. ..... 29/91.1; 5/475; 29/430; 29/173

[58] Field of Search ..... 29/91.1, 173, 430; 5/477, 475

[56] References Cited

U.S. PATENT DOCUMENTS

| | | | |
|---|---|---|---|
| 1,466,617 | 8/1923 | Foster | 5/477 |
| 4,401,501 | 8/1983 | Stumpf | 156/367 |
| 4,439,977 | 4/1984 | Stumpf | 53/428 |
| 4,566,926 | 1/1986 | Stumpf | 156/165 |
| 4,578,834 | 4/1986 | Stumpf | 5/477 |
| 4,854,023 | 8/1989 | Stumpf | 5/477 |
| 4,986,518 | 1/1991 | Stumpf | 5/477 |

*Primary Examiner*—Irene Cuda
*Assistant Examiner*—Marc W. Butler
*Attorney, Agent, or Firm*—Jones, Day, Reavis & Pogue

[57] ABSTRACT

A method is provided which provides an improved manner in which to manufacture innerspring constructions including individual springs. A rotating bristled brush is used to urge individual springs along a path from one position to another.

16 Claims, 3 Drawing Sheets

METHOD FOR MANUFACTURING MATTRESSES OR BOX SPRINGS, INCLUDING IMPROVED SPRING TRANSFER

TECHNICAL FIELD

This invention relates in general to a method and apparatus for manufacturing mattresses or box springs. More particularly, the invention relates to a method and apparatus for transferring, springs from a spring forming apparatus to a spring compression and pocketing station, for later placement within an upholstered innerspring construction, such as a mattress or box spring.

BACKGROUND OF THE INVENTION

The prior art is replete with innerspring constructions, such as mattresses or box springs, in which individual springs are formed and later combined with other elements such as border wires, wood, or upholstery, to create a mattress or box spring. An example of a box spring construction including individual springs is as shown in U.S. Pat. No. 4,399,573 to Baright, incorporated by reference. An example of a mattress innerspring construction is illustrated in U.S. Pat. No. 4,578,834 to Stumpf, incorporated by reference, which discloses the assembly of several steps of pocketed coils by means of "hot-melt" glue:. Such pocketed coils may be created as disclosed in U.S. Pat. No. 4,439,977 to Stumpf, incorporated by reference, which discloses a coiler which creates individual coil springs from wire. Coil springs exit the coiler and are transferred by gravity and/or compressed air along a curved rod to a pocketing apparatus, which compresses relaxed springs to a relatively short height, whereupon they are inserted into fabric pockets.

Although the above-mentioned prior art methods and apparatus include many advantages, shortcomings do exist. One such shortcoming is a limitation on speed due to the reliance on gravity and/or air pressure to transfer springs from one position to another Therefore, a need has been recognized for an improved method and apparatus for manufacturing springs for use in bedding, which includes a reliable and time-efficient manner in which to transfer springs from a spring forming apparatus to a spring compression pocketing station.

SUMMARY OF THE INVENTION

Generally described, the present invention is comprised of a rotating brush which urges springs along a path defined by an arcade rod along which the coil springs slide. More particularly, the brush includes deflectable bristles which urge the springs along the path during rotation of the brush and maintain the springs in place once they are in a coil compression zone.

Therefore, it is an object of the present invention to provide an improved method for manufacturing innerspring constructions such as mattresses or box springs.

It is a further object of the present invention to provide an improved method for manufacturing springs for use in bedding.

It is a further object of the present invention to provide a time-efficient manner in which to transfer springs from a spring forming apparatus to a spring compression and pocketing station.

It is a further object of the present invention to provide a method for transferring a spring along an arcuate path.

It is a further object of the present invention to provide a method for transferring spring along an arcuate path, such that the spring does not tend to reverse its travel along said path.

It is a further object of the present invention to provide a method for transferring a coil spring along an arcuate path, such that the spring does not tend to come frictionally engaged or "hung" along its path.

It is a further object of the present invention to provide a method for transferring a spring along a path at a rapid pace.

It is a further object of the present invention to provide a method for transferring springs along a path which is cost-effective in operation.

It is a further object of the present invention to provide a method for transferring a spring along a path, which is simple in operation and maintenance.

Other objects, features, and advantages of the present invention will become apparent upon reading the following detailed description of the preferred embodiment of the invention when taken in conjunction with the drawing and the appended claims.

DETAILED DESCRIPTION OF THE PREFERRED EMBODIMENT

Referring now to the figures, in which like numerals designate like objects throughout the several views.

General Construction and Operation

Figure 1:
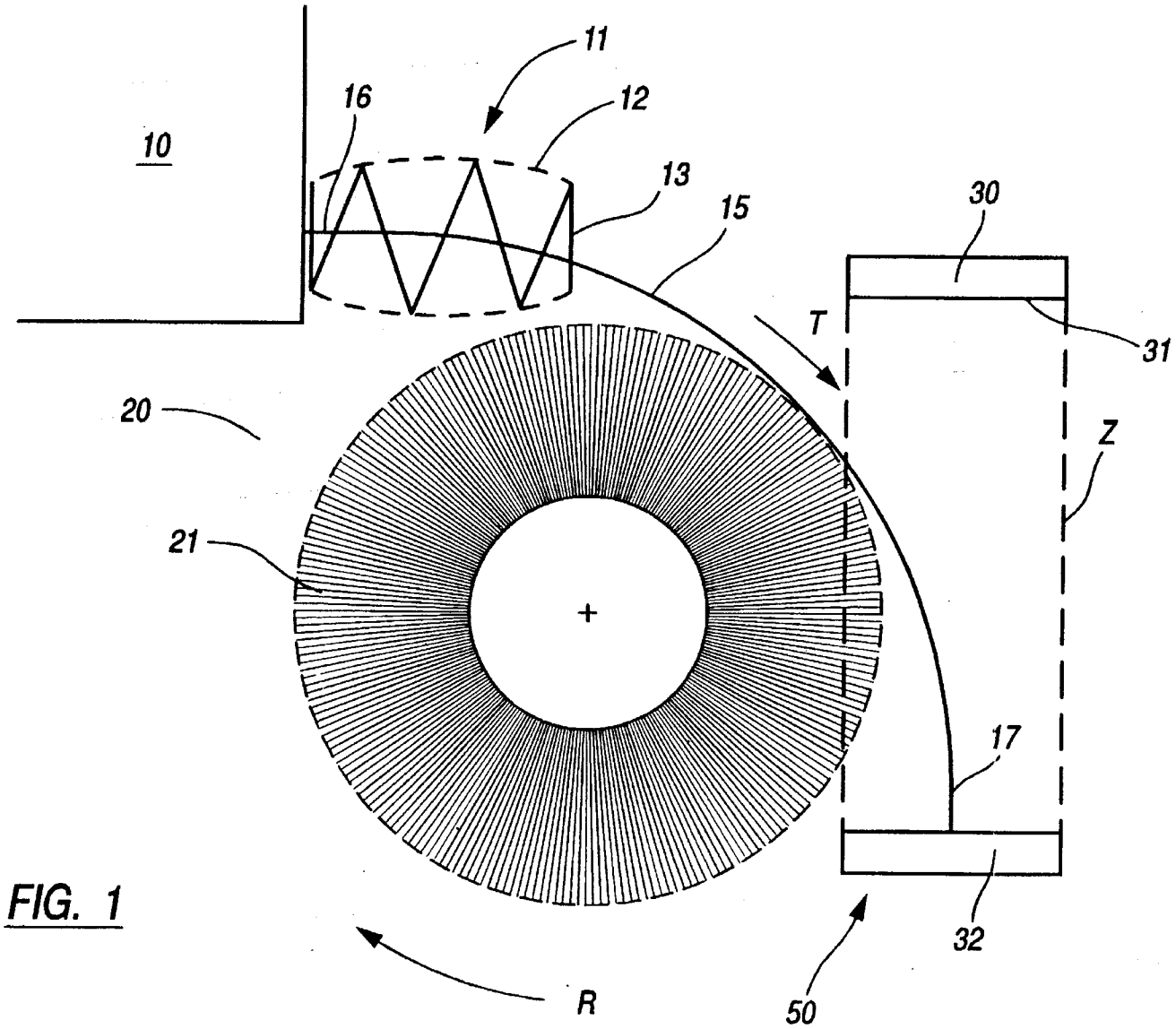
FIG. 1 is a view of a coil spring just as it is being deposited from a spring forming apparatus, such that the spring is threaded upon a curved or arcuate guide rod, which passes longitudinally through its center.

FIG. 1 is used to illustrate the general construction and operation of the present invention. As may be seen, a spring forming apparatus 10 is generally illustrated, which converts continuous wire fed from a roll (not shown) into individual coil springs 11 at its exit point.

After the coil springs 11 are formed and cut, they are individually deposited from the exit of the spring forming apparatus 10 and "threaded" onto the leading end 16 of a curved or arcuate guide rod 15 having a downstream end 17. A rotatable bristled brush 20 including a plurality of radially-extending bristles 21 is positioned adjacent to the arcuate rod 15 such that the bristles 21 of the brush 20 extend into the path of the coil springs 11 as they slidably travel along the arcuate rod 15.

As the brush 20 rotates in a clockwise rotational direction "R" (see FIG. 1), the springs 11 deposited upon the leading end 16 of the guide rod 15 are urged by the bristles 21 of the rotating brush 20 along an arcuate patch "T" similar in shape to the arcuate rod 15. The springs eventually stop at the downstream end 17 of the rod 15 and are maintained in place by the bristles 21 of the brush 20 as described in detail later.

Figure 2:
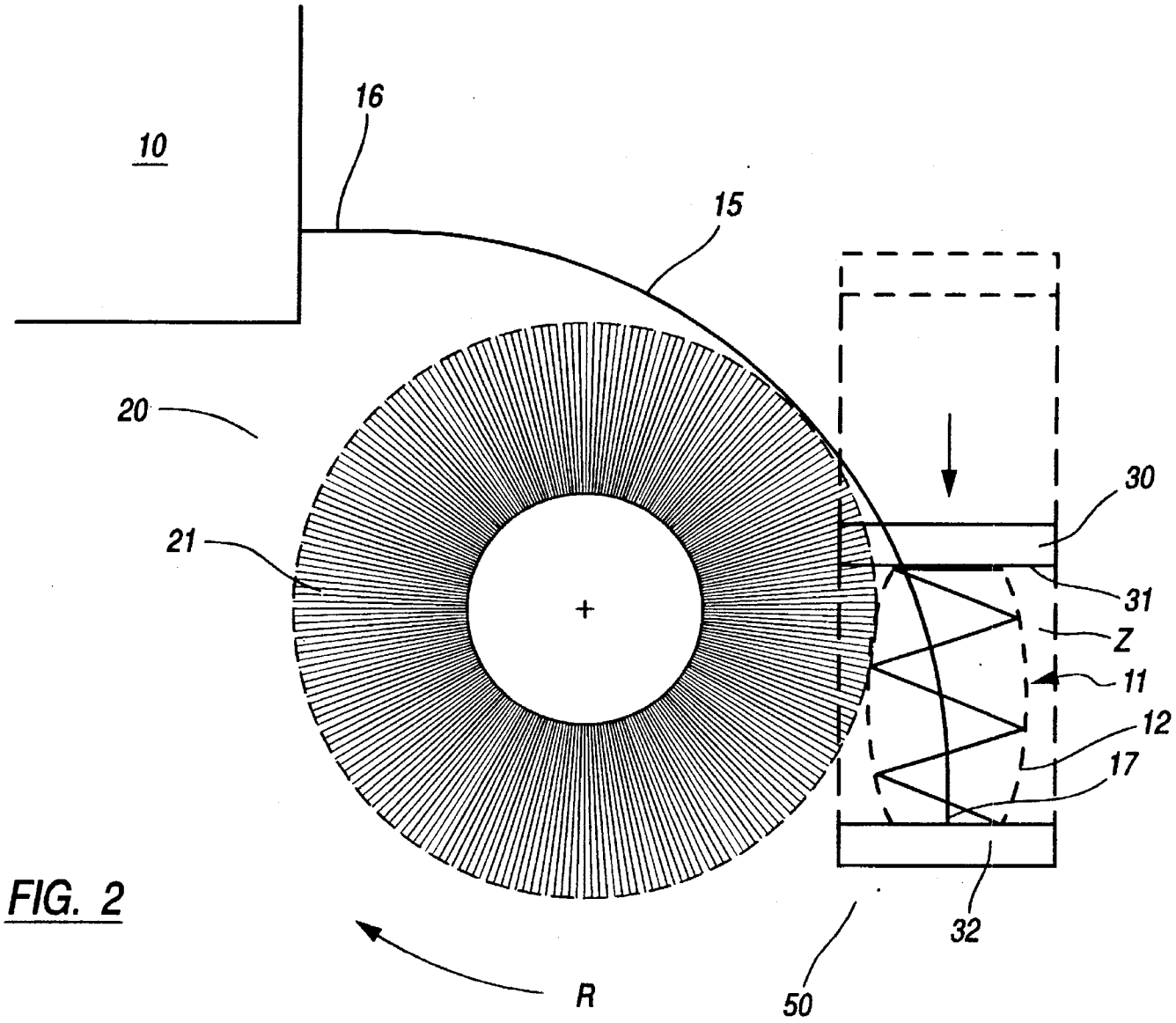
FIG. 2 is a view of a spring just as it is being compressed for later insertion into pocketing fabric.

Once the coil springs 11 are in place as shown in FIG. 2, they may be further processed. For example, they may be compressed and pocketing at a compression station 50 including a periodically vertically movable compression head 30 and a stationary base element 32 combining to define a compression zone Z. It may be understood that the compression head 30 defines a generally planar lower surface 31 for contact with the spring 11, but includes a slot configured to accept the rod 15 thickness during the compression stroke of the compression head 30.

Brush interference

For purposes of this discussion, a spring 11 as shown in FIG. 1, made out of wire 13, will be considered to define a 3-dimensional "spring volume" 12, shown in dotted line, which is shown as being barrel-shaped. The spring volume 12 will be considered to be defined by the convolutions of the wire.

As may be seen in FIG. 2, the bristles 21 of the brush 20 interfere with the spring volume 12 after the spring exits the spring forming apparatus 10, and thus provide urging forces upon the coils of the coil spring 11. This is an important feature of the invention in that this moves the spring 11 along the arcuate guide rod 15 at a rate faster than it would slide along the rod 15 under the influence of gravity and/or air pressure alone.

As also may be seen in FIG. 2, the bristles 21 of the brush 20 interfere with the spring volume 12 when the coil spring 11 is in place for compression. This is an important feature of the invention in that the brush bristles 21 tend to hold the coil spring 11 in place, and also tend to prevent the spring 11 from "bouncing back" out of the compression zone Z, which is a particular problem encountered in the industry.

The brush 20 is driven by a vane-type air motor (not shown) attached to a reduction box (not shown), such that the brush 20 rotates about a substantially horizontal rotational axis at a speed approximating 60–80 RPM, although this speed may be varied. However, it should be noted that it is preferred that the compressed air drive the tips of the brush bristles 21 at a speed faster than the spring would be traveling under the influence of gravity and/or air pressure. Therefore, it may be understood thin the brush 20 tends to provide an urging force by means of the bristles 21 to cause the spring 11 to travel at a rate faster than it would under its own weight.

As may be seen, the path of the coil spring 11 conforms somewhat to the outer diameter to the brush bristles 21. However, it may be understood that other positions of the brush bristles 21 are likewise contemplated under this invention, with other such positions being above or beside the arcuate guide rod 15. It is not necessary that the guide rod 15 be arcuate or curved; a brush or a plurality of brushes could be used in conjunction with a straight rod to push springs thereon.

Timing

The brush 20 may rotate continuously, but it has been found preferable to rotate the brush periodically, in order to save air needed to drive the vanes of its propelling motor. A preferable periodic operation of the brush 20 has been found to be to initiate brush rotation (typically by opening an air valve) simultaneously or approximately simultaneously with the cut-off and resulting release of the coil spring 11 from the spring forming apparatus 10. After the spring is so released, it is then picked up by the brush bristles 21 and urged thereby to the position shown in FIG. 2. At approximately the time the coil spring 11 comes in contact with the stationary base element 32, air driving the brush 20 is shut off. The brush 20 tends to come to a stop and is not easily movable due to friction and the presence of the speed reducer (not shown). At this point, the brush bristles 21, although stationary, tend to maintain the coil spring 11 in place by a type of spring action due to the deflectability of the brush bristles 21. This is an important part of the invention in that spring "bounce back" is reduced or prevented, which is disadvantageous in that the springs may bounce out of the compression zone Z.

Composition

The bristles 21 of the brush 20 in the preferred embodiment are composed of tampico, although other materials may be used, such as metal wire or synthetic material. Bristle diameter is approximately 0.030", although other sizes may be used. One preferred brush is ½" wide and 10 inches in outer diameter. One preferred air motor/reducer is that made by GAST and distributed by GRANGER under the model#4Z 412.

Overall System Operation

Figure 3:
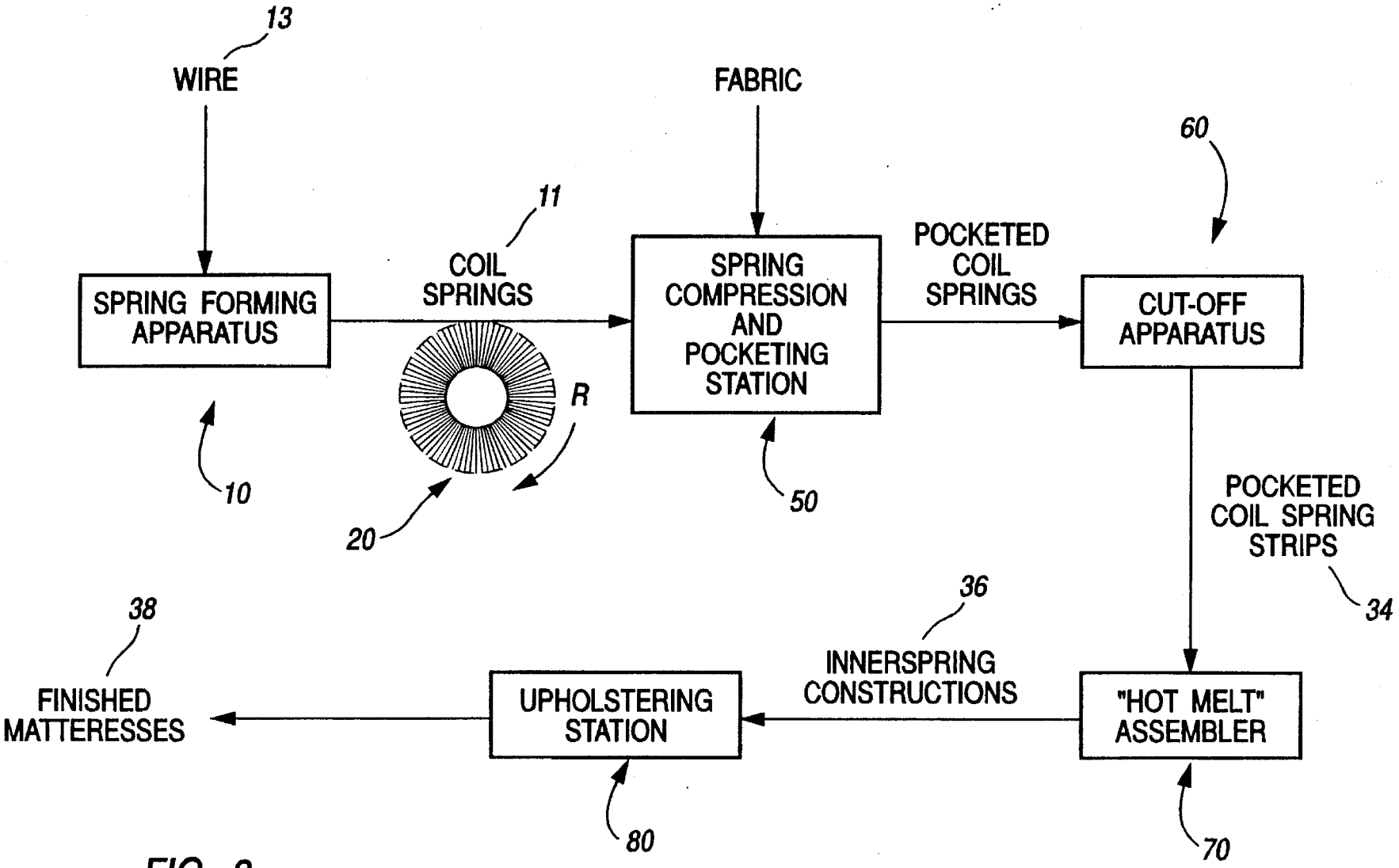
FIG. 3 is a step-by-step illustration of a manufacturing process according to the present invention.

Referring now to FIG. 3, a manufacturing process according to the present invention is disclosed. A spring forming apparatus 10 makes individual coil springs 11 from wire 13 and transfers these springs 11 (by assistance of the brush 20) to a spring compression and pocketing station 50, which pockets the compressed coil springs 11 into a continuous length of pocketed coil spring which are cut into a preferably uniform lengths by a known cut-off apparatus 60. The lengths or strips 34 of pocketed coil spring 11 are laid side-by-side and are adhere together by hotmelt assembler 70 to create innerspring constructions 36. Upper and lower peripheral border wires are added as known in the art. The innerspring constructions 36 are then upholstered at upholstered station 80, to create finished mattresses 38. Spring forming apparatus 10 and spring compression and pocketing station 50 which may be used in this manufacturing process are disclosed in U.S. Pat. No. 4,439,977, incorporated herein by reference. An apparatus such as cut-off apparatus 60 is disclosed in U.S. Pat. No. 4,491,491, incorporated herein by reference. An apparatus such as hot melt assembler 70 is shown in U.S. Pat. No. 4,566,926, incorporated herein by reference.

Conclusion

Therefore, it may be seen that the present invention provides an improved method and apparatus for providing coil springs within innerspring constructions, such as by providing improved transfer between a spring forming apparatus and a spring compression and pocketing station.

While this invention has been described in specific detail with reference to the disclosed embodiments, it will be understood that many variations and modifications may be effected within the spirit and scope of the invention as described in the appended claims.

What is claimed is:

1. A method for constructing mattress innerspring constructions, comprising the steps of:

a) forming wire coil springs in a spring forming apparatus;

b) depositing said coil springs from said spring forming apparatus onto a guide rod having a first end proximate said spring forming apparatus and a second distal end proximate a spring compression and pocketing station such that said guide rod passes through said coil springs;

c) urging said coil springs along said guide rod to a compression zone in said compression and pocketing station by use of a rotating brush proximate said guide rod, said rotating brush having deflectable bristles contacting said coil springs;

d) compressing said coil springs in said compression zone;

e) pocketing said compressed coil springs into a continuous length of pocketed coil springs; and f) incorporating said continuous length of pocketed coil springs into a mattress innerspring construction.

2. The method as claimed in claim 1, wherein said coil springs are urged down by deflected bristle contact at least a portion of a time they are in said compression zone.

3. The method as claimed in claim 1, wherein said guide rod curves along said rotating brush.

4. The method as claimed in claim 1, wherein said rotating brush is stopped from rotating while said coil springs are compressed.

5. The method as claimed in claim 4, wherein said rotating brush starts rotating from a stop after said coil springs are formed.

6. The method as claimed in claim 3, wherein said rotating brush is stopped from rotating while said coil springs are compressed.

7. The method as claimed in claim 6, wherein said rotating brush starts rotating from a stop after said coil springs are formed.

8. The method as claimed in claim 2, wherein said guide rod curves along said rotating brush.

9. The method as claimed in claim 8, wherein said rotating brush is stopped from rotating while said coil springs are compressed.

10. The method as claimed in claim 9, wherein said rotating brush starts rotating from a stop after said coil springs are formed.

11. The method as claimed in claim 10, wherein the rotating brush includes deflectable bristles comprised of tampico.

12. The method as claimed in claim 11, further comprising the step of upholstering said mattress innerspring construction to create an upholstered mattress.

13. A method for transferring springs from a first location to a second location, comprising the steps of:

a) depositing said spring onto a guide rod at said first location such that said rod passes through said spring; and b) urging said spring along said rod to said second location by use of a rotating brush proximate said guide rod and having deflectable bristles contacting said spring.

14. The method as claimed in claim 13, wherein said guide rod curves along said rotating brush.

15. The method as claimed in claim 13, wherein the rotating brush includes; deflectable bristles comprised of tampico.

16. The method as claimed in claim 14, wherein the rotating brush includes; deflectable bristles comprised of tampico.

* * * * *